US007523758B2

(12) United States Patent
Vanderroest et al.

(10) Patent No.: US 7,523,758 B2
(45) **Date of Patent: *Apr. 28, 2009**

(54) DISHWASHER HAVING ROTATING ZONE WASH SPRAYER

(75) Inventors: Chad T. Vanderroest, Watervliet, MI (US); Jay Landsiedel, Kewanee, IL (US); Antony M. Rappette, Beton Harbor, MI (US); David Hung Chi Chen, St. Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 398 days.

This patent is subject to a terminal disclaimer.

(21) Appl. No.: 11/026,770

(22) Filed: Dec. 30, 2004

(65) Prior Publication Data

US 2005/0150529 A1 Jul. 14, 2005

Related U.S. Application Data

(63) Continuation-in-part of application No. 10/463,263, filed on Jun. 17, 2003.

(51) Int. Cl.
*B08B 3/02* (2006.01)

(52) U.S. Cl. ..... 134/56 D; 134/57 D; 134/177; 134/178; 134/198; 134/200

(58) Field of Classification Search ..... 134/56 D, 134/57 D, 58 D, 175, 176, 177, 178, 179, 134/198, 199, 200
See application file for complete search history.

(56) References Cited

U.S. PATENT DOCUMENTS 1,598,352 A * 8/1926 Kehoe, Jr. et al. ..... 239/222.19
1,897,821 A 2/1933 Poli
2,407,533 A 9/1946 Brock
2,918,927 A 12/1959 Clearman
3,060,944 A 10/1962 Brollo
3,217,721 A 11/1965 Hertel
3,253,784 A 5/1966 Long et al.

(Continued)

FOREIGN PATENT DOCUMENTS

DE 3403359 8/1985

(Continued)

OTHER PUBLICATIONS

Bosch User Manual for Dishwasher, p. 22, Downloaded From Boschappliances.com on Feb. 15, 2005.*

(Continued)

*Primary Examiner*—Michael Barr
*Assistant Examiner*—Saeed T Chaudhry
(74) *Attorney, Agent, or Firm*—John Morrison; Michael D. Lafrenz

(57) ABSTRACT

A dishwasher has multiple wash zones which are each supplied by a wash liquid supply. An interior tub configured to provide an interior wash chamber for washing dishes is divisible into a plurality of wash zones supplied by separate wash liquid supplies. One of the wash zones is supplied by a spray manifold having rotating spray heads. The spray heads are provided with internal vanes which urge the spray heads to rotate and direct wash liquid to outlets in the spray heads.

43 Claims, 12 Drawing Sheets

U.S. PATENT DOCUMENTS

| | | | | |
|---|---|---|---|---|
| 3,586,011 | A | 6/1971 | Mazza | |
| 3,648,931 | A | 3/1972 | Jacobs | |
| 3,718,149 | A | 2/1973 | Mazza | |
| 3,828,818 | A | 8/1974 | Hunt | |
| 3,915,180 | A | 10/1975 | Jacobs | |
| 4,094,702 | A | 6/1978 | Rabuffetti | |
| 4,279,384 | A | 7/1981 | Yamamoto | |
| 4,320,781 | A | 3/1982 | Bouvet et al. | |
| 5,131,419 | A | 7/1992 | Roberts | |
| 5,331,986 | A | 7/1994 | Lim et al. | |
| 5,494,062 | A | 2/1996 | Springer | |
| 5,849,101 | A | 12/1998 | Edwards et al. | |
| 6,003,529 | A | 12/1999 | Perry, Jr. | |
| 6,666,220 | B2 | 12/2003 | Spanyer et al. | |
| 6,869,029 | B2 | 3/2005 | Ochoa, Sr. et al. | 239/380 |
| 2003/0168087 | A1 | 9/2003 | Inui et al. | |
| 2004/0173249 | A1 | 9/2004 | Assmann et al. | |
| 2005/0022847 | A1 * | 2/2005 | Nito et al. | 134/57 D |
| 2005/0224098 | A1 | 10/2005 | Fujii et al. | |

FOREIGN PATENT DOCUMENTS

| | | | | |
|---|---|---|---|---|
| DE | 19544985 | | | 6/1996 |
| DE | 10124645 | | | 12/2001 |
| EP | 0291713 | A1 | | 11/1988 |
| EP | 0517015 | A1 | | 12/1992 |
| EP | 0755650 | A1 | | 1/1997 |
| EP | 0786230 | A2 | | 7/1997 |
| EP | 1252856 | | | 10/2002 |
| EP | 1488730 | A1 | | 12/2004 |
| GB | 668181 | | | 3/1952 |
| JP | 1176127 | | * | 3/1999 |
| JP | 11076127 | | * | 3/1999 |
| WO | 00/22973 | A1 | | 4/2000 |
| WO | 2004058035 | A1 | * | 7/2004 |

OTHER PUBLICATIONS

The Perfect Ten, 2005 American Building Product Awards, Home Magazine, Homemag.com, Published Feb. 2005.*

Asko Unveils New Dishwasher, Appliance Magazine, Published May 8, 2003, Downloaded From Appliancemagazine.com Sep. 26, 2005.*

Dishwashers, Power at a Price, Consumer Reports, p. 34, Published Mar. 2005.*

Bosch SHU43 Built-In Dishwasher, Epinions.com, Published Jan. 26, 2001.*

First Look, Power Washer, p. 91, Good Housekeeping Magazine, Published Sep. 2004.*

* cited by examiner

DISHWASHER HAVING ROTATING ZONE WASH SPRAYER

CROSS-REFERENCE TO RELATED APPLICATION

This application is a continuation-in-part of U.S. application Ser. No. 10/463,263, filed Jun. 17, 2003.

BACKGROUND OF THE INVENTION

1. Field of the Invention

The present invention relates to dishwashers. In one aspect, the invention relates to a dishwasher having a zone wash manifold with rotating sprayers. In another aspect, the invention relates to a dishwasher having an enhanced spray pattern for optimizing the cleaning effectiveness of the dishwasher. In yet another aspect, the invention relates to a dishwasher having an improved cooking utensil cleaning capability.

2. Background

Modem dishwashers include a tub and an upper and lower rack or basket for supporting soiled dishes within the tub. A pump is provided for re-circulating wash liquid throughout the tub to remove soils from the dishes. Typically, larger dishes such as casserole dishes which have a propensity to be heavily soiled are carried on the lower rack and lighter soiled dishes such as cups and glasses are provided on an upper rack. The racks are generally configured to be moveable in or out of the tub for loading and unloading.

One of problems associated with the typical modern dishwasher is that the dishes receive somewhat uniform wash treatment no matter their positioning within a rack in the dishwasher. For example, in a typical dishwasher, a lower wash arm rotates about a vertical axis and is provided beneath the lower rack for cleaning the dishes on the lower rack and an upper wash arm is provided beneath the upper rack for cleaning the dishes on the upper rack. Dishes in the upper rack receive somewhat uniform wash treatment and dishes in the lower rack receive somewhat uniform wash treatment. Accordingly, lightly soiled dishes in either dish rack are subject to the same wash performance as the highly soiled dishes in the same wash rack, which can lead to poor wash performance of the highly soiled dishes. As a result, it would be advantageous to provide a dishwasher with a second or concentrated wash zone for washing larger dishes such as the casserole dishes, which are more likely to be heavily soiled.

Another problem associated with the modem dishwasher is that to achieve optimal wash performance of heavily soiled, larger dishes, the dishes may need to be loaded with the surface that needs to be washed face down. The face down approach allows the lower spray arm to reach the heavily soiled surface. Accordingly, it would be advantageous if the dishwasher could be provided with a second wash zone that allowed the heavily soiled dishes to be loaded in an upright position, thereby optimizing the number of dishes that can be loaded in the dishwasher on any given cycle. It would also be advantageous if the dishwasher allowed for a customized wash cycle option which optimized the use of the second wash zone.

A stationary zone wash spray manifold in combination with a rotating spray arm assembly is highly effective in washing heavily soiled dishes which are loaded in an upright position. However, the combination of spray from a conventional rotating spray arm assembly and a zone wash spray manifold contributes to high water usage. While the cleaning of the heavily soiled dishes may be optimized with this assembly, the high volume of wash liquid required results in less volume delivered to other spray assemblies and potentially less effective cleaning of other dishes. The stationary manifold also limits the size of the wash zone, thereby limiting the effectiveness of the cleaning operation.

SUMMARY OF THE INVENTION

A dishwasher comprises a tub defining a wash chamber for receiving utensils for washing and a manifold located within the wash chamber and comprising at least one rotating spray head comprising at least one outlet for providing a circulating spray of wash liquid into the wash chamber to provide a wash zone. The manifold can be mounted to the tub.

A spray arm can be included and configured to rotate within the tub and spray a flow of wash liquid into the wash chamber thereby providing another wash zone.

The pressure/force of the wash liquid exiting the at least one outlet is greater than for a similarly configured non-rotating spray head, and the area covered by the circulating spray is greater than a similarly configured non-rotating spray head.

The at least one rotating spray head can comprise a front plate and a back plate to define a chamber therebetween, which is in fluid communication with the manifold such that wash liquid passing through the manifold can be transferred to the rotating spray head. The at least one outlet is arranged on the front plate such that the wash liquid exiting the at least one opening causes the rotating spray head to rotate. One or more arcuate vanes can be located on the rear surface of the front plate such that the wash liquid entering the interior of the rotating spray head will contact the vane and cause the spray head to rotate. The vane can also be arranged such that it directs the wash liquid to the at least one outlet.

The at least one spray head can be rotatably attached to the manifold through a shaft, which can have the form of a bearing hub inserted through the axial opening of the back plate and attached to the manifold with a fastener.

The at least one rotating spray head can comprise a plurality of outlets, which can be distributed adjacent to and away from an axis of rotation of the at least one rotating spray head. The manifold can have a plurality of wash liquid conduits for supplying a plurality of spray heads.

DETAILED DESCRIPTION OF AN EMBODIMENT OF THE INVENTION

Figure 1:
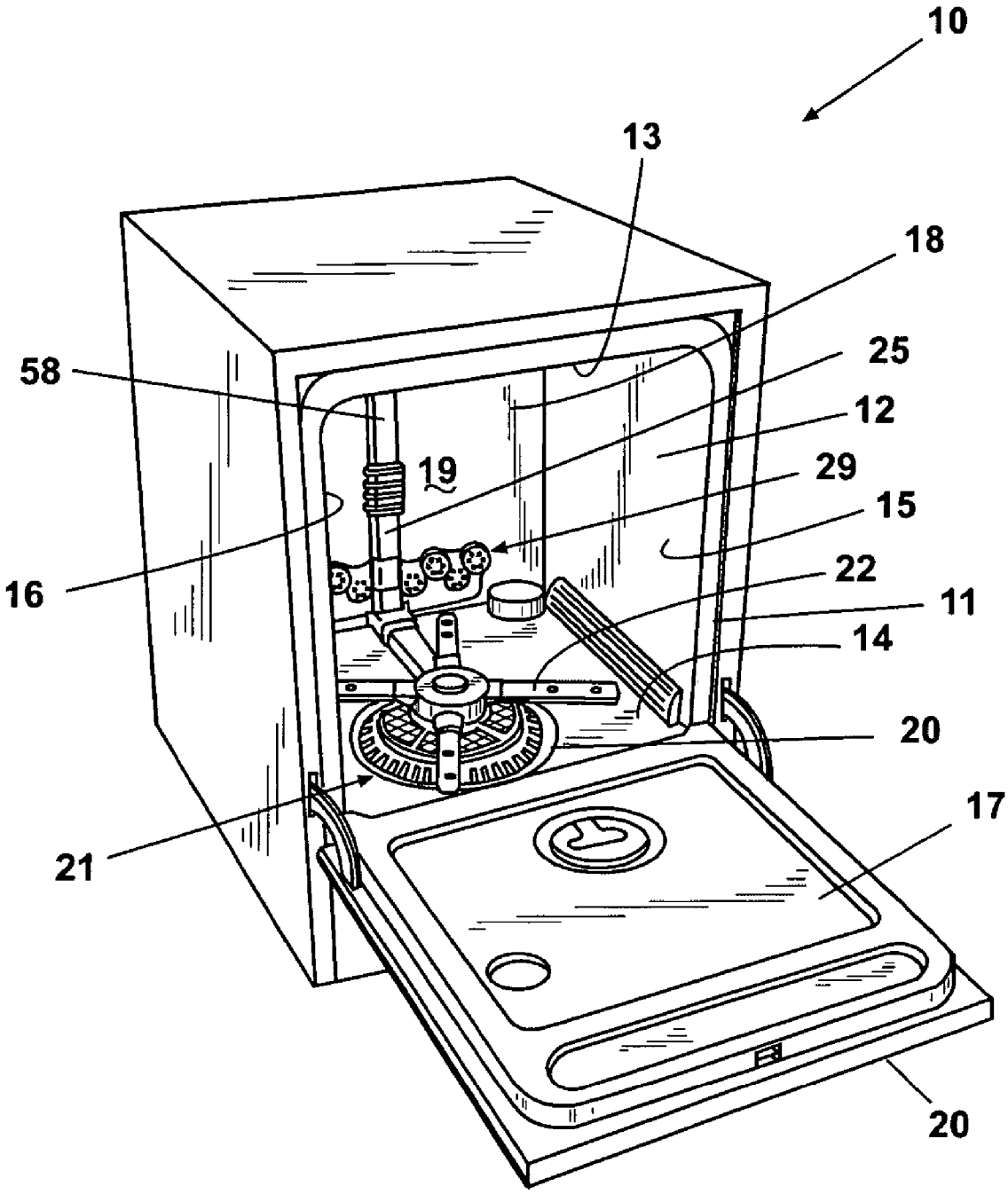
FIG. 1 is a perspective view of a dishwasher having an interior with multiple wash zones in accordance with the present invention.
Figure 2:
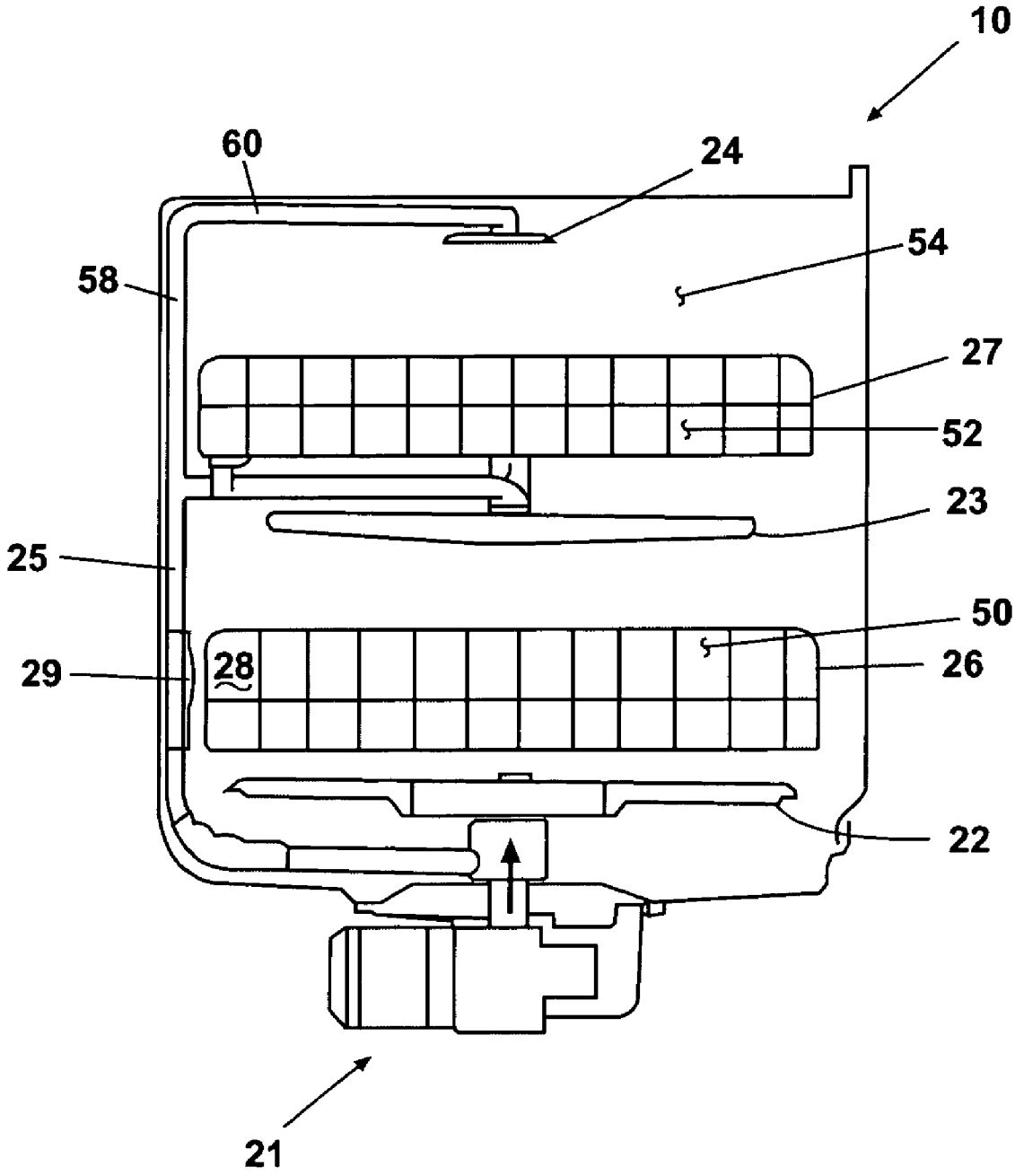
FIG. 2 is a schematic, cross-sectional view of the dishwasher shown in FIG. 1, showing the dish racks mounted in the tub, upper and lower spray arm assemblies, a spray manifold, and a third-level spray assembly having a control valve as contemplated by the present invention.

Referring now to the drawings, wherein like numerals indicate like elements throughout the views, FIGS. 1 and 2 illustrate an exemplary embodiment of a multiple wash zone dishwasher 10 in accordance with the present invention. In the embodiment shown generally in FIGS. 1 and 2, the dishwasher 10 comprises several elements found in a conventional dishwasher, including an interior tub 12 having a top wall 13, a bottom wall 14, two side walls 15, 16, a front wall 17, and a rear wall 18, which form an interior wash chamber or dishwashing space 19 for washing dishes. The front wall 17 can be replaced with an opening 11 which can be selectively closed with a door 20, which can be pivotally attached to the dishwasher 10 for providing accessibility to the dishwashing space 19 for loading and unloading dishes or other washable items. While the present invention is described in terms of a conventional dishwashing unit as illustrated in FIG. 1, it can also be implemented in other types of dishwashing units such as in-sink dishwashers or drawer dishwashers.

The bottom wall 14 of the dishwasher can be sloped to define a lower tub region or sump 20 of the tub 12. A pump assembly 21 can be located in or around a portion of the bottom wall 14 and in fluid communication with the sump 20 to draw wash liquid from the sump 20 and to pump the liquid to at least a lower spray arm assembly 22. If the dishwasher has a mid-level spray arm assembly 23 and/or an upper spray arm assembly 24, liquid can be selectively pumped through a fluidly-connected lower supply tube 25 and upper supply tube 58 to the assemblies 22-24 for selective washing.

As shown in FIG. 2, the lower supply tube 25 extends generally rearwardly from the pump assembly 21 to the rear wall 18 of the tub and upwardly to supply wash liquid to the mid-level spray arm assembly 23. The upper supply tube 58 extends generally upwardly from the lower supply tube 25 to supply wash liquid to the upper spray arm assembly 24. The upper spray arm assembly 24 is fluidly connected to the upper supply tube 58 through a top wall spray tube 60, which extends generally along and parallel to the top wall 13.

In the exemplary embodiment, the lower spray arm assembly 22 is positioned beneath a lower dish rack 26, the mid-level spray arm assembly 23 is positioned between an upper dish rack 27 and the lower dish rack 26, and the upper spray arm assembly 24 is positioned above the upper dish rack 27. As is typical in a conventional dishwasher, the lower spray arm assembly 22 is configured to rotate in the tub 12 and spray a flow of wash liquid in a generally upward direction over a portion of the interior of the tub 12. The spray from the lower spray arm assembly 22 is typically directed to providing a wash for dishes located in the lower dish rack 26. Like the lower spray arm assembly 22, the mid-level spray arm assembly 23 can also be configured to rotate in the dishwasher 10 and spray a flow of wash liquid in a generally upward direction over a portion of the interior of the tub 12. In this case, the spray from the mid-level spray arm assembly 23 is directed to dishes in the upper dish rack 27. Typically, the upper spray arm assembly 24 generally directs a spray of wash water in a generally downward direction and helps wash dishes on both dish racks 26, 27.

The spray of wash liquid from the lower spray arm assembly 22 defines a first "wash zone" 50 which, in the embodiment illustrated in FIG. 2, extends generally upwardly from the lower spray arm assembly 22 to a region extending somewhat above the lower dish rack 26. The spray of wash liquid from the mid-level spray arm assembly 23 defines a second "wash zone" 52 which, in the embodiment illustrated in FIG. 2, extends generally upwardly from the mid-level spray arm assembly 23 to a region generally coextensive with the upper dish rack 27. The spray of wash liquid from the upper spray arm assembly 24 defines a third "wash zone" 54 which, in the embodiment illustrated in FIG. 2, extends generally downwardly from the upper spray arm assembly 24 to a region generally coextensive with the upper dish rack 27.

In addition to one or more of the conventional spray arm wash assemblies described above, the present invention further comprises a fourth "wash zone", or more particularly, an intensified wash zone 28. While in the exemplary embodiment the intensified wash zone 28 is located adjacent the lower dish rack 26 toward the rear of the tub 12, it could be located at virtually any location within the interior tub 12. The intensified wash zone 28 has been designed to enable heavily soiled dishes, such as casserole dishes, to receive the traditional spray arm wash, as well as an additional concentrated wash. Thus, a dishwasher having such a zone will not only provide better washing performance for heavily soiled dishware, but will provide overall improved wash performance.

Figure 3:
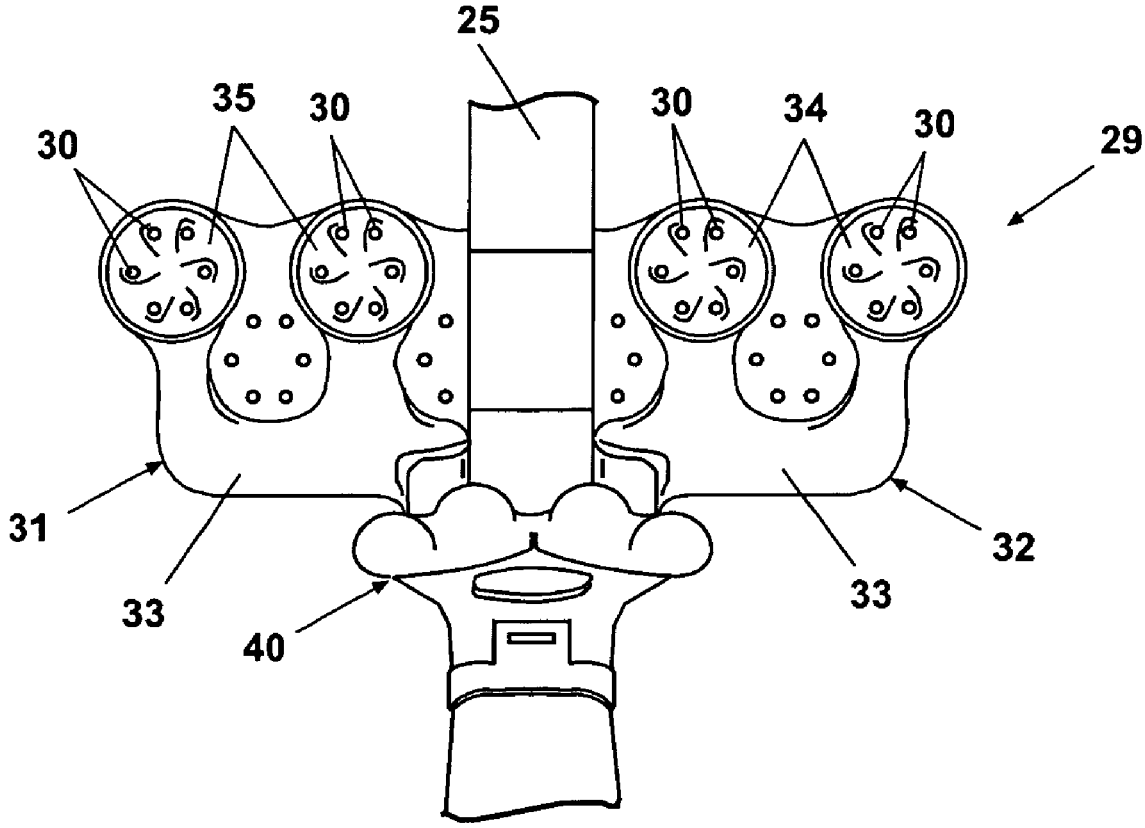
FIG. 3 is a front elevational view of a spray manifold in accordance with the exemplary embodiment of the present invention.

As illustrated in FIG. 3, the intensified wash zone 28 is achieved by selectively diverting wash liquid from the upper spray arm assemblies 23, 24 to a vertically oriented spray manifold 29 positioned on the rear wall 18 of the interior tub 12 adjacent the lower dish rack 26. In this way, a flow of wash liquid is directed toward the lower dish rack 26 from the manifold 29, thereby defining the intensified wash zone 28. As one of skill in the art should recognize, the spray manifold 29 is not limited to this configuration; rather, the spray manifold 29 can be located in virtually any part of the interior tub 12. For example, the manifold 29 could be moved up vertically along any portion of the wash liquid supply tube 25 such as to a position adjacent the upper dish rack 27. Alternatively, the manifold 29 can be positioned beneath the lower dish rack 26 adjacent or beneath the lower wash arm assembly 22. The illustrated configuration of the spray manifold 29 enables casserole dishes to be loaded in an upright position, to maximize or optimize the number of dishes that can be loaded in any given cycle.

In the exemplary embodiment, the spray manifold 29 is in fluid communication with the wash liquid supply tube 25 such that wash liquid can be selectively provided to the manifold 29. The manifold 29 is configured to have two symmetrically opposing halves 31, 32 positioned on opposite sides of the supply tube 25 with each half being configured to selectively receive wash liquid being pumped through the supply tube 25. Each half 31, 32 of the manifold 29 comprises a plurality of apertures 30 configured to spray wash liquid into the wash zone 28. Additionally, each half of the manifold 29 is configured with one or more passageways 33 to deliver wash liquid from the supply tube 25 to the apertures 30. As one of skill in the art will appreciate, the wash liquid being pumped through the supply tube 25 will be under pressure as it passes through passageway 33 and out apertures 30, thereby creating an intensified wash zone 28.

As illustrated in FIG. 3, each half 31, 32 of the spray manifold 29 comprises two substantially circular nozzles 34, 35 having a plurality of apertures 30 arranged in a substantially circular pattern. Each aperture 30 has a substantially oval shape and can selectively be oriented at a predefined angle with respect to the nozzle or with respect to the spray manifold 29. The spray manifold 29 can also extend across virtually any width of the interior wash tub 12, or can be limited to extending to only one side of the supply tube 25. Moreover, the number of nozzles 34, 35 can be selectively varied, as well as the height and positioning of each nozzle. Additionally, the shape, size, angle, arrangement, and number of apertures 30 in the manifold 29 can be varied to provide a more concentrated wash zone. For example, not only can the manifold 29 be configured to provide water flow to a particular zone, but the manifold can also be configured to provide a higher water flow.

Figure 4A:
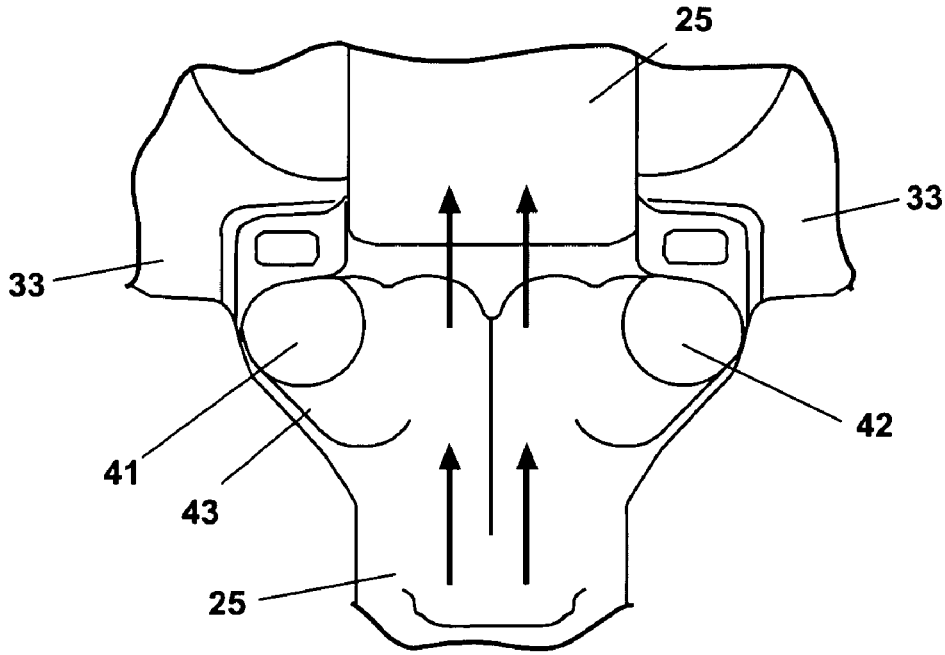
FIG. 4A is a schematic view of a first position of a valve for selectively diverting wash liquid to a supply tube in accordance with the exemplary embodiment of the present invention.
Figure 4B:
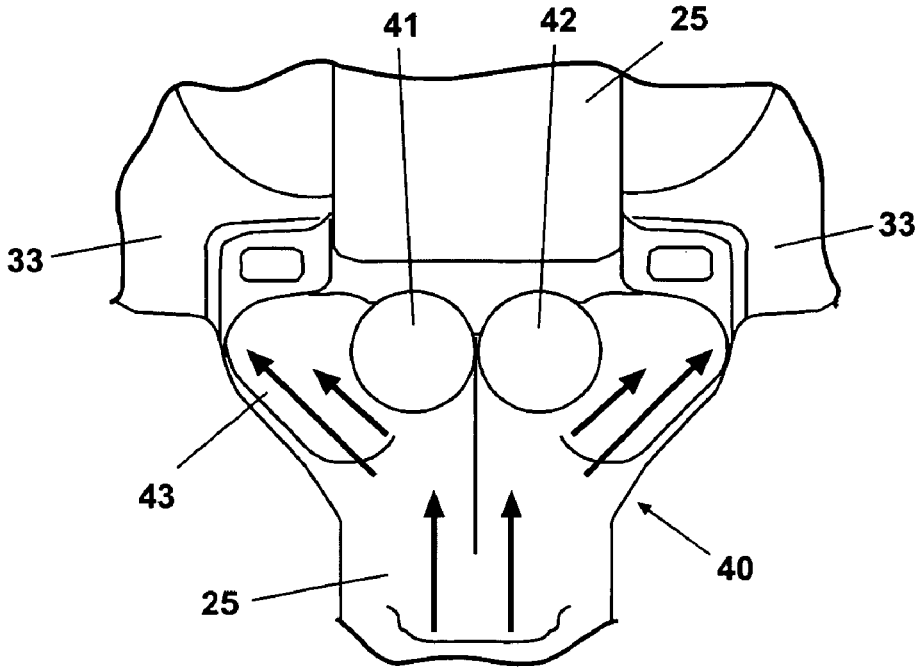
FIG. 4B is a schematic view of a second position of a valve for selectively diverting wash liquid to a spray manifold in accordance with the exemplary embodiment of the present invention.

As shown generally in FIG. 3 and more specifically in FIGS. 4A and 4B, a valve 40 can be provided to selectively divert wash liquid from the upper spray arm assemblies 23, 24 to the spray manifold 29. In the exemplary embodiment, the valve 40 is a magnetically actuatable diverter valve positioned in the supply tube 25 and is configured to direct the flow of wash liquid either through the supply tube 25 so it can reach the upper spray arm assemblies or through the spray manifold so it can reach the intensified wash zone 28. As one of skill in the art should appreciate, the valve could also be designed to selectively divert water from the lower spray arm.

In the exemplary embodiment, the valve 40 comprises a housing 43 and two diverter objects such as magnetic balls 41, 42 preferably having a ferrite core positioned within the housing and configured to be magnetically moved between a first position shown in FIG. 4A and a second position shown in FIG. 4B. In the first position, the diverter objects 41, 42 are magnetically positioned to substantially block passageway 33 associated with both halves 31, 32 of the spray manifold. In this way, wash liquid is prevented from entering the manifold and is pushed through the supply tube 25 toward the mid-level and upper spray arm assemblies. In the second position, the diverter objects 41, 42 are magnetically positioned to substantially block the supply tube 25, thereby allowing the wash liquid to enter both halves of the manifold through the passageway 33. While the exemplary embodiment illustrates a diverter valve using a plurality of magnetic objects, such as magnetic balls, to divert wash water between the upper spray arms and the manifold 29, one of skill in the art will recognize that an arrangement of flapper valves, wedges, or other known water diverter mechanisms can also be used.

Figure 5:
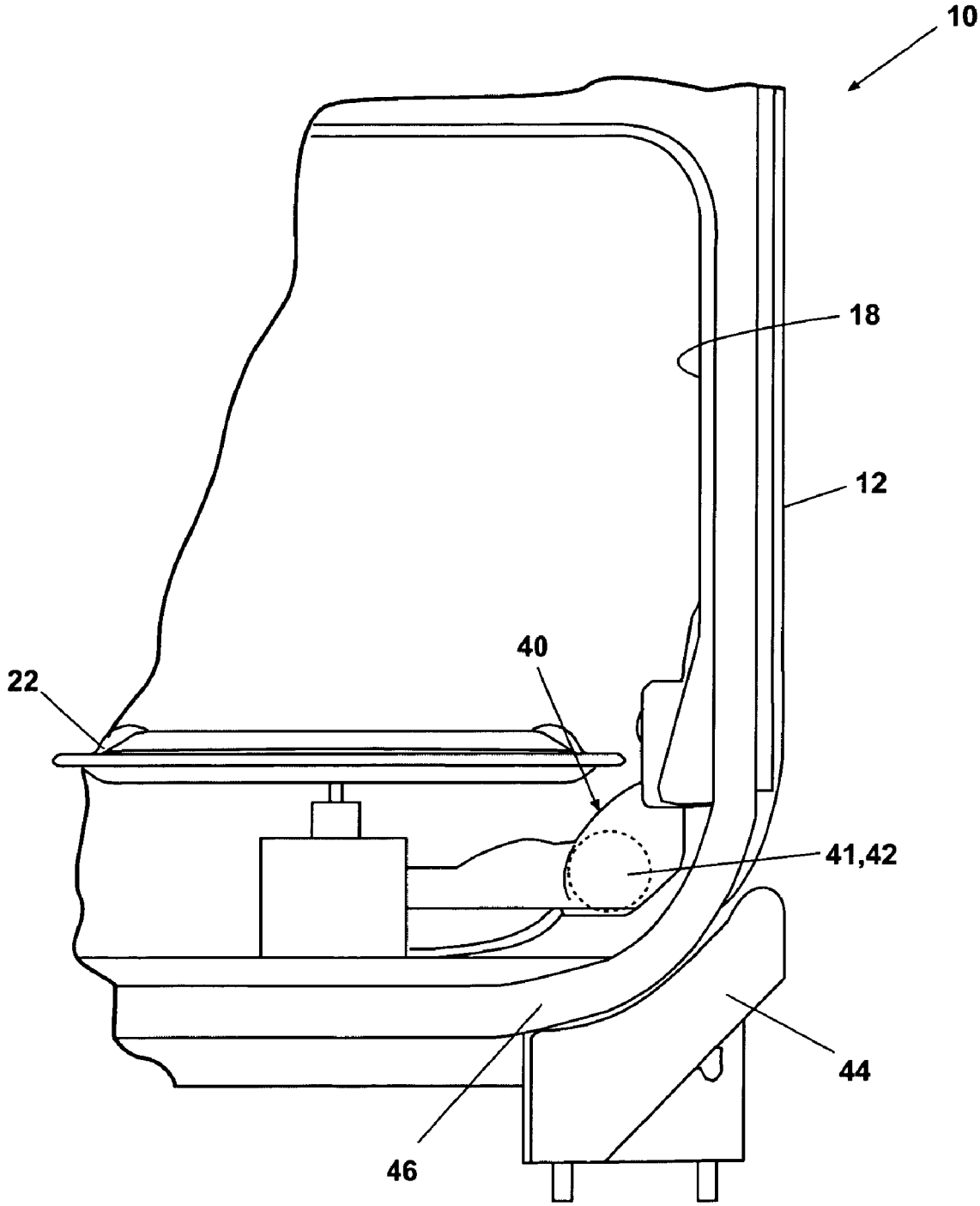
FIG. 5 is a schematic view of a valve and actuator as contemplated by the present invention.

As shown in FIG. 5, an actuator 44 is positioned outside of the housing 43 and behind the tub 12 for magnetically moving the objects from the first position to the second position and vice versa. In the exemplary embodiment, the actuator 44 comprises a magnet with sufficient strength to magnetically manipulate the diverter objects (41, 42). It should be recognized that the magnet could be a permanent magnet, electromagnet or any other type magnet configured to move the diverter objects. The actuator 44 can be configured to be mounted to the outside 46 of the tub 12 in a variety of configurations and can be configured to be in communication with and controlled by the dishwasher's control panel (not shown) or the wash programs associated with the dishwasher 10. It should be recognized that to take advantage of the intensified wash zone, the dishwasher might be configured with customized wash cycle options that provide for zone actuation at optimal cycle intervals.

Figure 6:
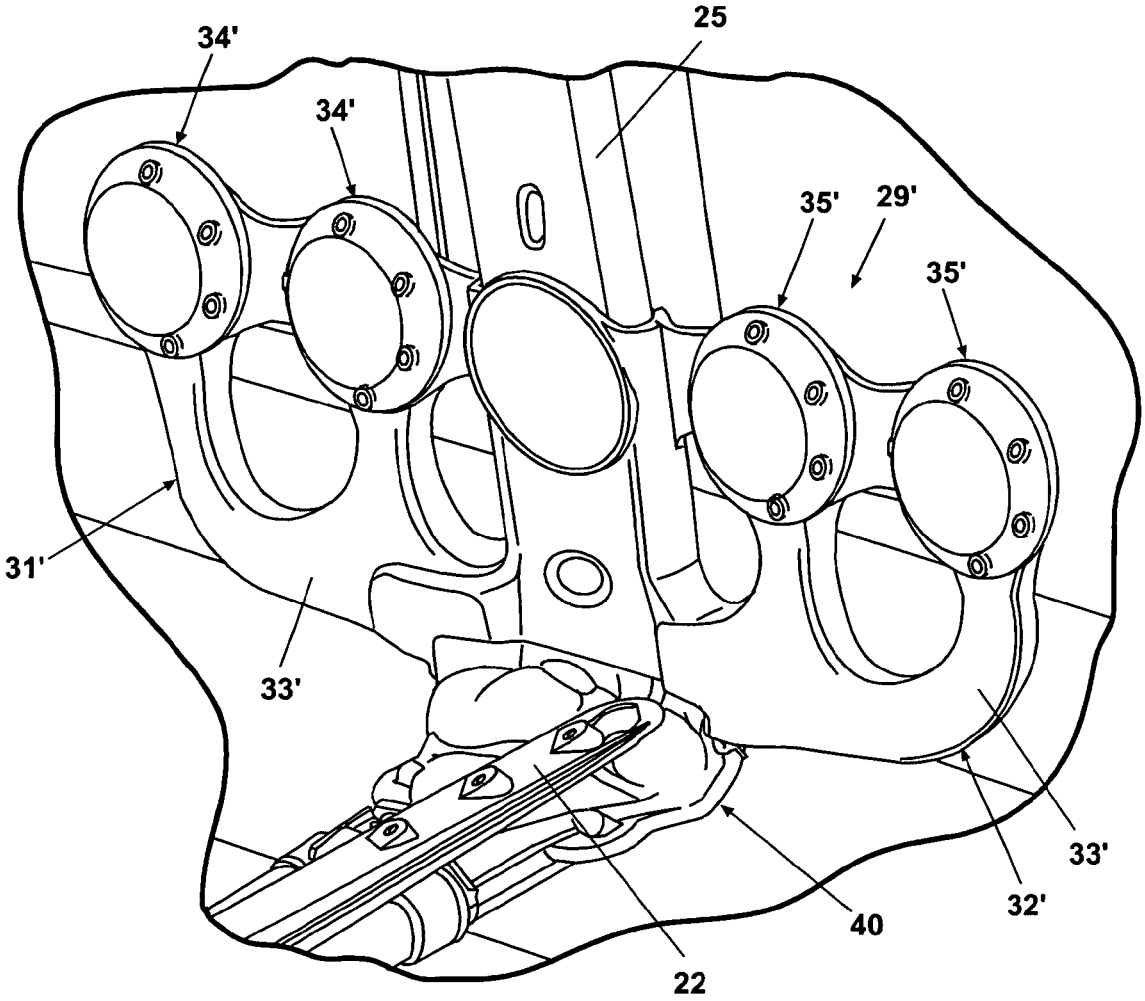
FIG. 6 is an enlarged perspective view of a zone wash spray manifold with rotating spray heads according to the invention.

Referring now to FIG. 6, an alternate embodiment of the spray manifold 29, identified hereinafter with the numeral 29', is illustrated. The spray manifold 29' shares many of the elements of the spray manifold 29, and thus like elements will hereinafter be identified with like numerals. The main difference between the two embodiments is that the alternate embodiment has rotating nozzle assemblies 34' and 35', which permit a broader spray coverage area with a great spray pressure/force than what is achievable with the fixed spray nozzles.

Figure 7:
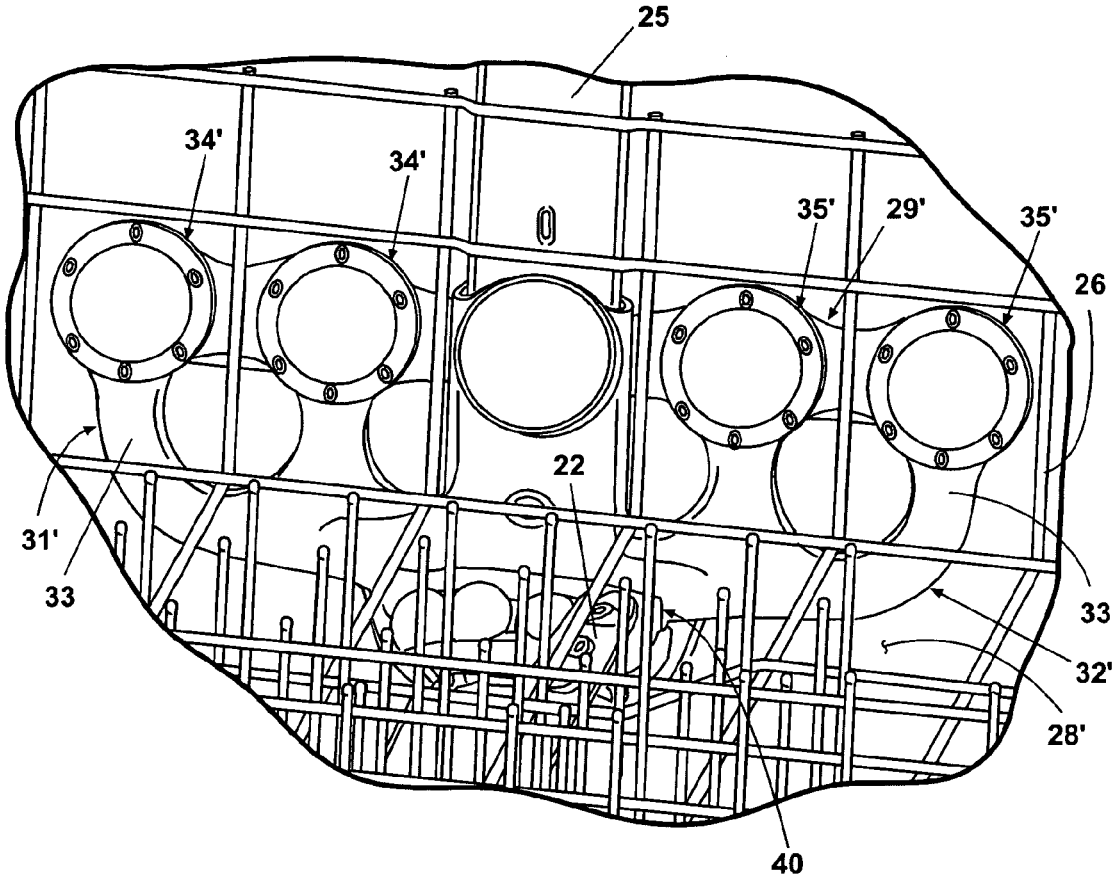
FIG. 7 is an enlarged perspective view of the zone wash spray manifold of FIG. 6 illustrating its position relative to a lower dish rack.
Figure 9:
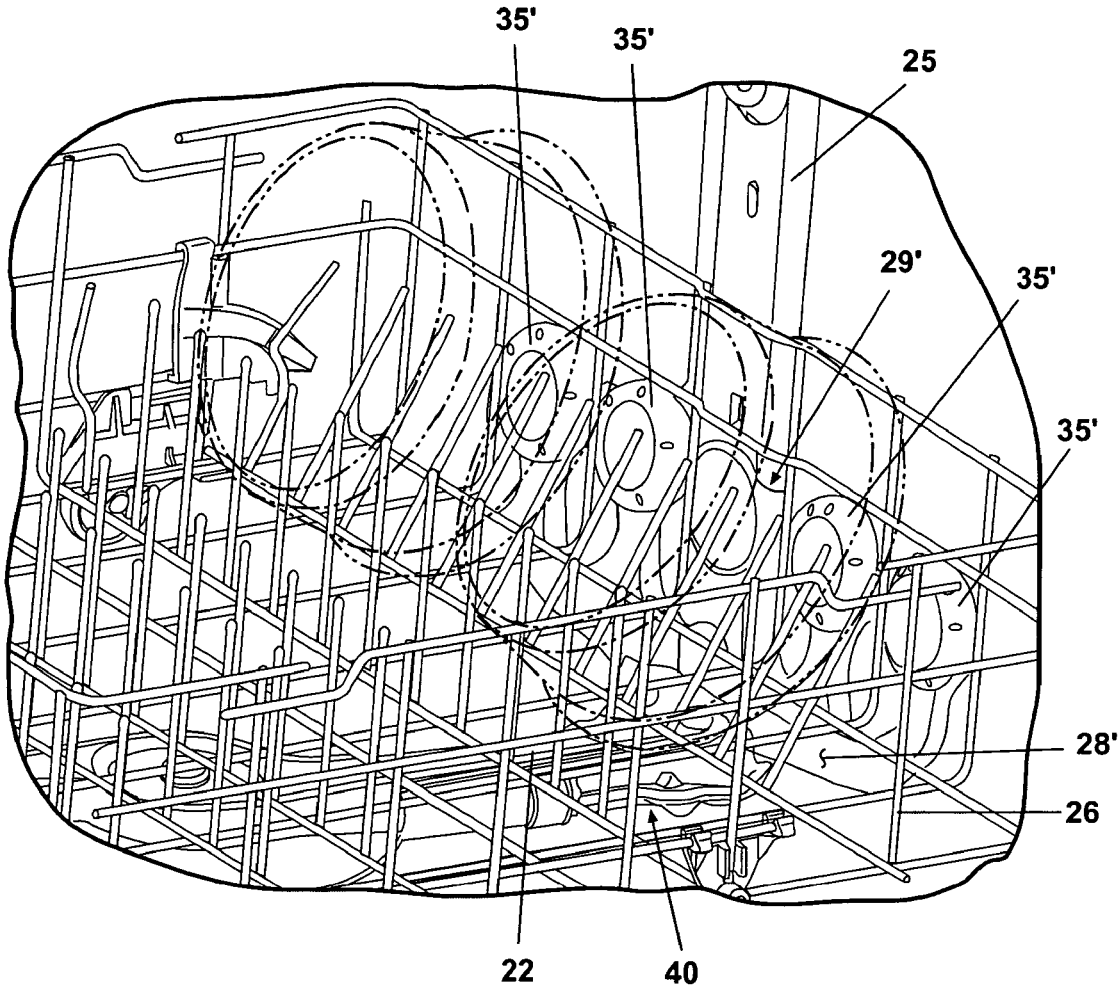
FIG. 9 is a perspective view of a pair of exemplary cooking utensils supported in the lower dish rack of FIG. 7 and oriented relative to the zone wash spray manifold for optimized cleaning.
Figure 10:
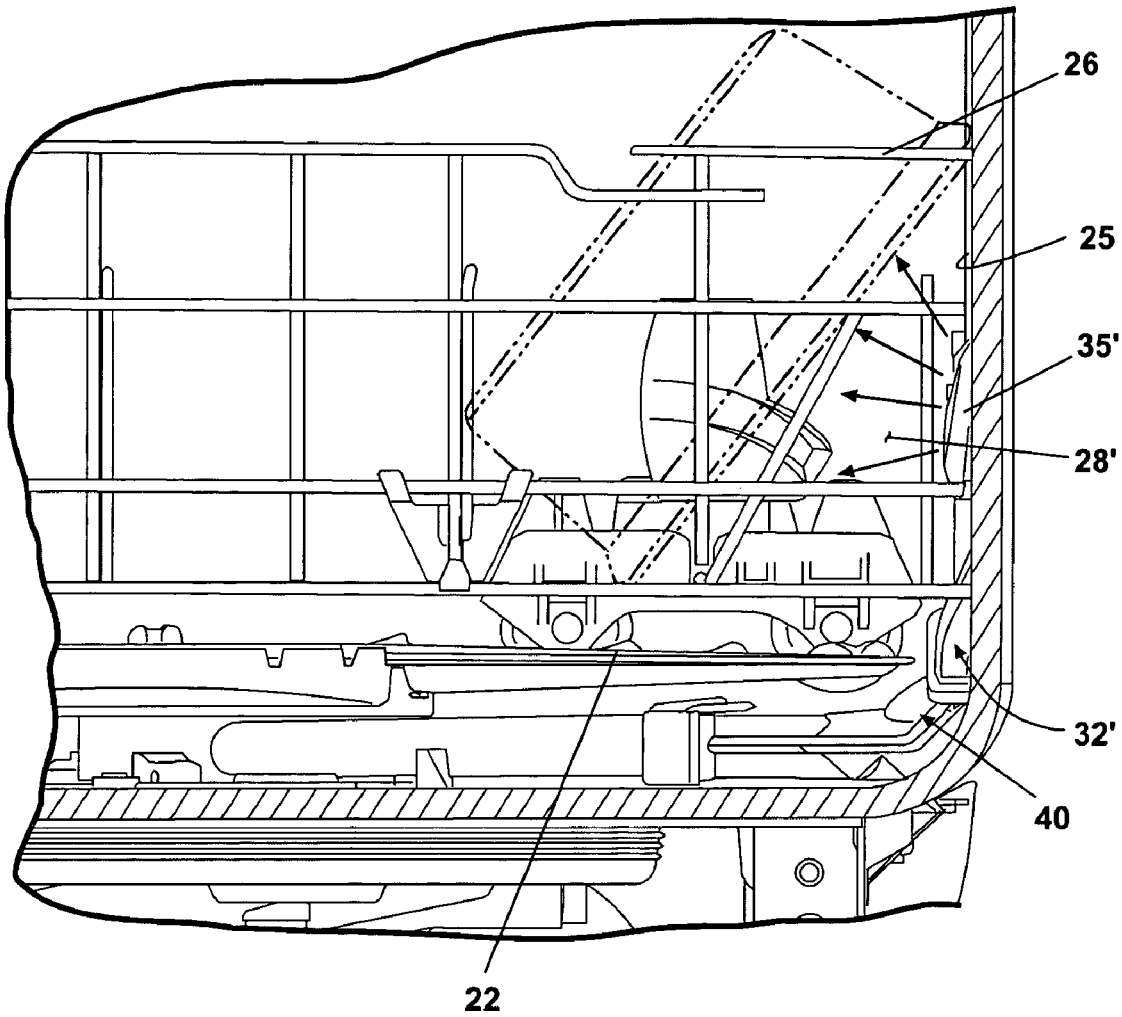
FIG. 10 is a side view of the exemplary cooking utensils supported in the lower dish rack illustrated in FIG. 9 showing the spray pattern from the lower spray arm assembly and zone wash spray manifold with rotating spray heads.

The spray manifold 29' is in fluid communication with the wash liquid supply tube 25, and comprises two symmetrically opposing halves 31', 32'. Each half 31', 32' of the manifold 29' is configured with one or more fluid passageways 33'. A valve 40 is fluidly connected to the manifold 29' to selectively divert wash liquid from the upper spray arm assemblies 23, 24 to the passageways 33'. As illustrated in FIGS. 7, 9, and 10, the spray manifold 29' is positioned within the wash chamber 19 to spray wash liquid against dishes supported in the lower dish rack 26 and within an intensified wash zone 28'.

Figure 8A:
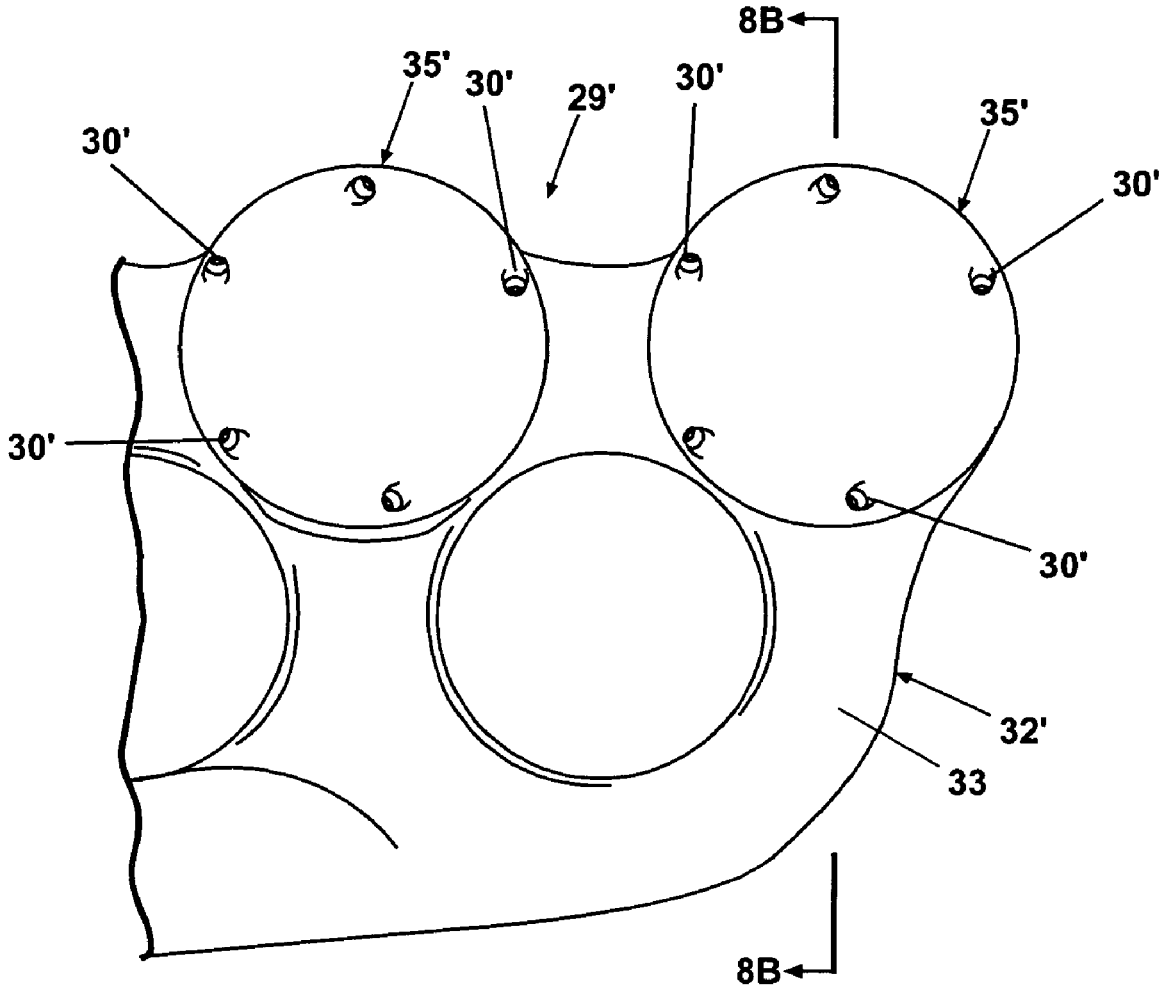
FIG. 8A is an enlarged perspective view of a portion of the zone wash spray manifold illustrated in FIG. 6.
Figure 8B:
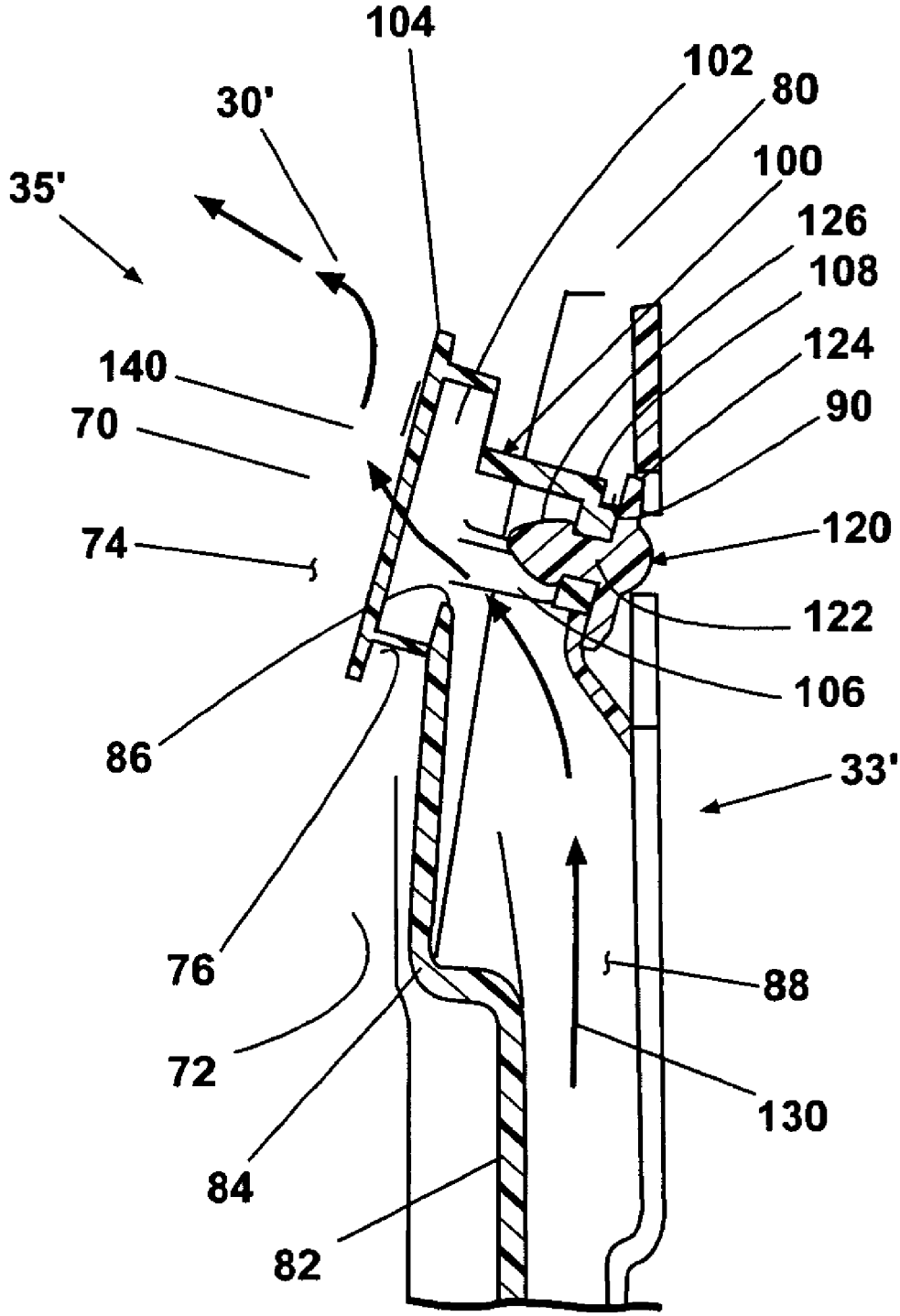
FIG. 8B is a sectional view of a taken along view line 8B-8B of FIG. 8A.
Figure 8C:
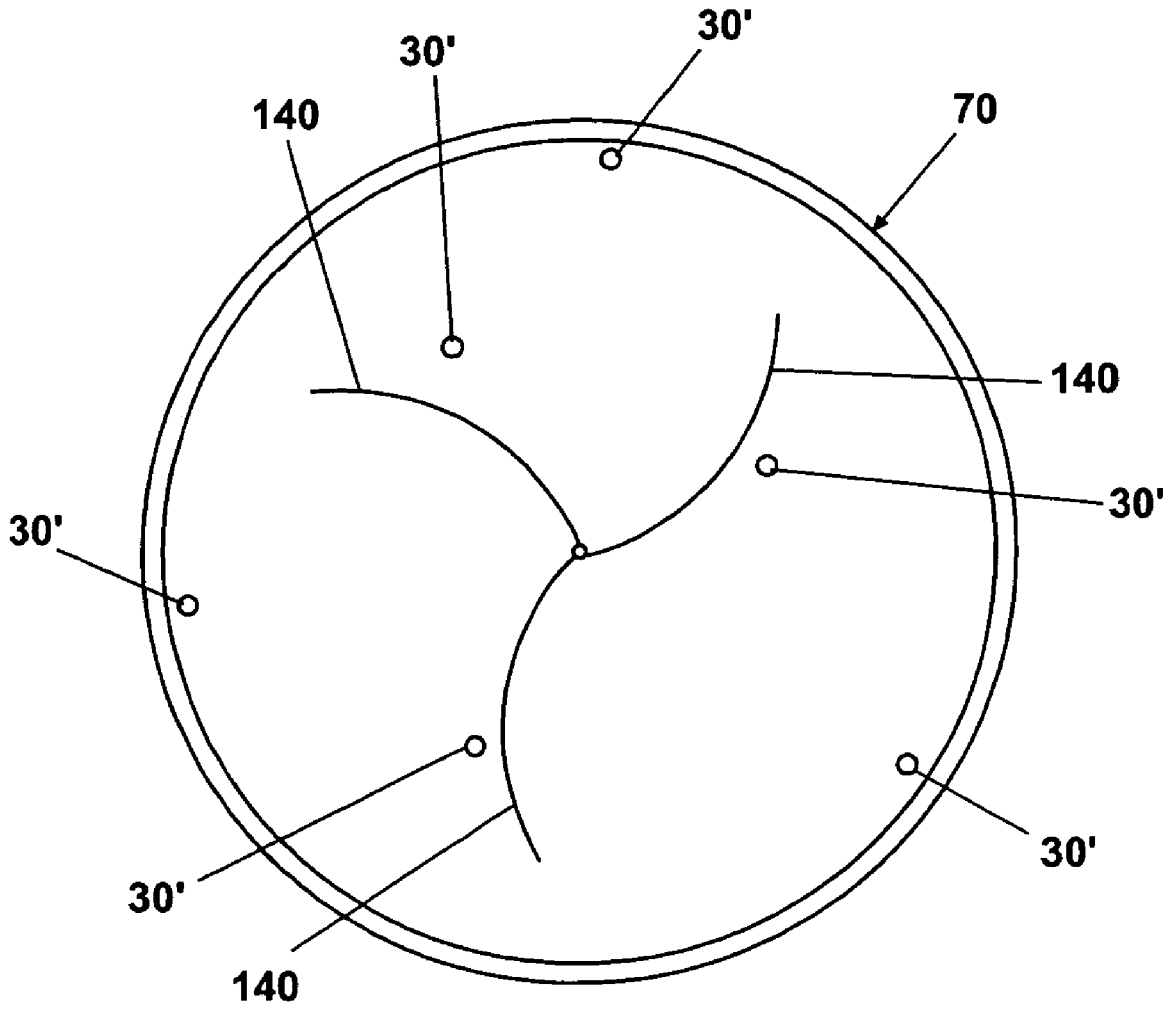
FIG. 8C is an enlarged plan view of the interior of a rotating spray head illustrated in FIG. 6.

Referring now to FIGS. 8A-C, each half 31', 32' of the spray manifold 29' comprises two substantially circular rotating nozzle assemblies 34', 35'. Each nozzle assembly 34', 35' comprises a circular front plate 70 having an arcuate cross-section and a circular backplate 72. The backplate 72 is provided with a circular aperture 76 extending coaxially therethrough. The front plate 70 and the backplate 72 are adapted for coaxial registry through a suitable well-known connection, such as an adhesive, an interference or snap fit, sonic welding, and the like, to join the front plate 70 and the backplate 72 in order to form an interior space 74.

The front plate 70 has a plurality of raised apertures 30' arranged to direct a stream of wash liquid flowing therefrom in a generally tangential direction in order to impart a rotation to the nozzle assembly 34', 35'. The orientation of each aperture 30' relative to the surface of the front plate 70 and relative to a radial line extending between the aperture 30' and the center of the front plate 70 is selected in order to impart a preferred rotation velocity and spray pattern to the nozzle assembly 34', 35'. The number of nozzle assemblies 34', 35' can be selectively varied, as well as the height and positioning of each nozzle assembly 34', 35' along the front plate 70. The shape, size, angle, arrangement, and number of apertures 30' can also be selected to provide a more concentrated wash zone and/or a faster/slower rotation. It is preferred that the number of apertures 30' be less than the number for the fixed nozzle assemblies 34, 35, which will result in an increase in the pressure/force of the wash liquid exiting the nozzles for a given supply pressure through the valve 40. The increased pressure/force of the wash liquid can be used for better cleaning.

The inner surface of the front plate 70 is also provided with a plurality of raised arcuate vanes or ribs 140 (FIG. 8C), extending from a common junction at the axial center of the front plate 70 outwardly toward the perimeter of the front plate 70. While three vanes are illustrated, greater or fewer than three can be used. The curvature of the vanes aids in effecting the rotation of the nozzle assemblies 34', 35'. The vanes 140 also direct the flow of water outwardly toward the apertures 30'.

The passageway 33' comprises a rear wall 80 and a front wall 82 to define an interior space 88 therebetween. The front wall 82 transitions to a circular mounting wall 84 having an opening 86 therein in fluid communication with the interior space 88. The mounting wall 84 is configured for cooperative registry with the backplate 72. The rear wall 80 is provided with a circular aperture 90 therethrough in coaxial alignment with the opening 86.

A bearing hub 100 is used along with a retaining pin 120 to rotationally retain the nozzle assemblies 34', 35' to the structure forming the passageway 33'. The bearing hub 100 is a generally cylindrical body comprising an annular bearing ring 102 on one end and an annular locking ring 108 on another end. A plurality of spaced extension fingers extend between the bearing ring 102 and locking ring 108. An annular retaining flange 104 circumscribes the bearing ring 102 along a first side of the bearing ring 102. The spaces between the fingers form fluid passages that establish fluid communication between the interior space 88 of the passageway 33', 34' and the interior space of the nozzle assemblies 34', 35'.

The retainer pin 120 is a generally circular body comprising a center shaft 122 transitioning coaxially at a first end to a circular, platelike flange 124 and at a second end to a somewhat conical locking tip 126. The locking tip 126 is adapted to be inserted through the locking ring 108 for retention therein, with the center shaft 122 extending through the locking ring 108. The diameter of the flange 124 on the retainer pin 120 is somewhat greater than the diameter of the aperture 90 in the back wall 80.

The diameter of the bearing ring 102 is somewhat smaller than the diameter of the aperture 76 in the backplate 72 to enable the backplate 72 to rotate relative to the bearing hub 100. The diameter of the retaining flange 104 is somewhat greater than the diameter of the aperture 76 so that the bearing hub 100 is retained in the aperture 76 with the retaining flange 104 in the interior space 74. The diameter of the opening 86 in the front wall 82 is somewhat smaller than the diameter of the bearing ring 102.

The bearing hub 100 is coupled to the nozzle assembly 34', 35' by inserting the extension fingers 106 through the aperture 86 so that the retaining flange 104 is on the opposite side of the backplate 72 than the fingers 106, the bearing ring 102 loosely extends through the aperture 86 and bears against the mounting wall 84. The retainer pin 120 is then inserted through the aperture 90 and the locking ring 108 so that the retainer pin 120 is retained in the locking ring 108 and the flange 124 is adjacent the back wall 80 to attach the nozzle assembly 34', 35' to the passageway 33'. The nozzle assembly 34', 35' can then rotate relative to the passageway 33' as wash liquid travels up the interior space 88, through the bearing hub 100 into the interior space 74, and out the raised apertures 30', as illustrated by the flow vectors 130.

The use of a rotating zone wash sprayer enhances the cleaning effectiveness of the zone wash sprayer. The rotation of the wash liquid stream covers a greater soil area with less volume of wash liquid. Because less volume is used, increased wash liquid pressure is maintained at all zones and sprayers, thereby enhancing the overall cleaning effectiveness of the dishwasher. A rotating zone wash sprayer also subjects soil particles on utensils to streams of wash liquid that approach the particles from different directions. This enhances the lifting and removal of soil particles from the utensils.

The foregoing detailed description of the invention has been presented for purposes of illustration and description. It is not intended to be exhaustive nor limit the invention to the precise form disclosed. Many alternatives, modifications and variations have been discussed above, and others will be apparent to those skilled in the art in light of the above teaching.

We claim:

1. A dishwasher comprising:

a tub defining a wash chamber for receiving utensils for washing;

a first rack located in the wash chamber for supporting utensils therein and having a bottom side and a peripheral side extending upwardly from the bottom side and terminating in an upper edge;

a first spray arm assembly configured to rotate within the tub and spray a first flow of wash liquid into the wash chamber thereby providing a first wash zone along the bottom side of the first rack; and a manifold located within the wash chamber, adjacent at least a portion of the peripheral side and located below the upper edge, and comprising a plurality of rotating spray heads laterally arranged along the peripheral side, with each spray head comprising at least one outlet spraying a second flow of wash liquid toward and through the at least a portion of the peripheral side to provide a second wash zone along the at least a portion of the peripheral side.

2. A dishwasher according to claim 1, and further comprising a second rack located in an upper portion of the wash chamber, and wherein the first rack is located in a lower portion of the wash chamber.

3. A dishwasher according to claim 2, wherein the second wash zone is located directly adjacent the first rack.

4. A dishwasher according to claim 1, wherein the manifold is mounted to the tub.

5. A dishwasher according to claim 1, wherein the velocity of the wash liquid exiting the at least one outlet is greater than for a similarly configured non-rotating spray head.

6. A dishwasher according to claim 5, wherein the area covered by the circulating spray is greater than a similarly configured non-rotating spray head.

7. A dishwasher according to claim 1, wherein each rotating spray head comprises spaced front and back plates to define a chamber therebetween that is fluidly connected to the manifold for the transfer of wash liquid from the manifold and into the chamber.

8. A dishwasher according to claim 7, wherein each rotating spray head comprises a plurality of outlets distributed adjacent to and away from an axis of rotation of the spray head.

9. A dishwasher according to claim 8, wherein the outlets are arranged on the spray head such that wash liquid exiting the outlets causes the rotating spray head to rotate about the axis of rotation.

10. A dishwasher according to claim 9, wherein the front plate has a rear surface facing the chamber and at least one vane extends from the rear surface such that wash liquid entering the chamber and contacting the vane will effect the rotation of the spray head.

11. A dishwasher according to claim 10, wherein the at least one vane directs the wash liquid to at least one of the outlets.

12. A dishwasher according to claim 1, wherein each rotating spray head comprises a plurality of outlets distributed adjacent to and away from an axis of rotation of the at least one rotating spray head.

13. A dishwasher according to claim 12, wherein the manifold has a plurality of wash liquid conduits for supplying the plurality of spray heads.

14. A dishwasher according to claim 1, wherein the first spray arm assembly is located in the tub beneath the bottom side of the first rack and the first flow of wash liquid is directed upwardly toward the first rack.

15. A dishwasher according to claim 1, wherein each rotating spray head is directly adjacent the peripheral side.

16. A dishwasher according to claim 1, wherein the first flow of wash liquid from the first spray arm assembly is sprayed upwardly toward the bottom of the first rack and the second flow of wash liquid from the plurality rotating spray heads is sprayed laterally toward the at least a portion of the peripheral side.

17. A dishwasher according to claim 16, wherein the first wash zone and the second wash zone intersect near the at least a portion of the peripheral side.

18. A dishwasher according to claim 17, wherein the first spray arm is located beneath the bottom of the first rack and each rotating spray head is located directly adjacent the at least a portion of the peripheral side.

19. A dishwasher according to claim 1, wherein the second wash zone is more intensified than the first wash zone.

20. A dishwasher according to claim 1, wherein the second wash zone is more concentrated than the first wash zone.

21. A dishwasher comprising:

a tub defining a wash chamber for receiving utensils for washing;

a first rack located in the wash chamber for supporting utensils therein and having a bottom side and a peripheral side extending upwardly from the bottom side and terminating in an upper edge; and a manifold located within the wash chamber, adjacent at least a portion of the peripheral side and located at a height below the upper edge, and comprising a plurality of rotating spray heads laterally arranged along the peripheral side, with each spray head comprising at least one outlet spraying a circulating flow of wash liquid toward and through the at least a portion of the peripheral side to provide a wash zone along at least the portion of the peripheral side.

22. A dishwasher according to claim 21, wherein the manifold is mounted to the tub.

23. A dishwasher according to claim 21, wherein the velocity of the wash liquid exiting the at least one outlet is greater than for a similarly configured non-rotating spray head.

24. A dishwasher according to claim 23, wherein the area covered by the circulating spray is greater than a similarly configured non-rotating spray head.

25. A dishwasher according to claim 21, wherein each rotating spray head comprises spaced front and back plates to define a chamber therebetween that is fluidly connected to the manifold for the transfer of wash liquid from the manifold and into the chamber.

26. A dishwasher according to claim 25, wherein each rotating spray head comprises a plurality of outlets distributed adjacent to and away from an axis of rotation of the at least one rotating spray head.

27. A dishwasher according to claim 26, wherein the outlets are arranged on the spray head such that wash liquid exiting the outlets causes the rotating spray head to rotate about the axis of rotation.

28. A dishwasher according to claim 25, wherein the front plate has a rear surface facing the chamber and at least one vane extends from the rear surface such that wash liquid entering the chamber and contacting the vane will effect the rotation of the spray head.

29. A dishwasher according to claim 21, wherein each rotating spray head comprises a plurality of outlets distributed adjacent to and away from an axis of rotation of the at least one rotating spray head.

30. A dishwasher according to claim 29, wherein the outlets are arranged on the spray head such that wash liquid exiting the outlets causes the rotating spray head to rotate about the axis of rotation.

31. A dishwasher according to claim 30, wherein the manifold has a plurality of wash liquid conduits for supplying the plurality of spray heads.

32. A dishwasher according to claim 21, wherein the manifold is directly adjacent the peripheral side.

33. A dishwasher comprising:

a tub defining a wash chamber for receiving utensils for washing;

a first rack located in the wash chamber for supporting utensils therein and having a bottom side and a peripheral side extending upwardly from the bottom side and terminating in an upper edge;

a first spray arm assembly configured to rotate within the tub and spray a first flow of wash liquid into the wash chamber thereby providing a first wash zone along the bottom side of the first rack; and a manifold located within the wash chamber and comprising a plurality of rotating spray heads, each spray head located at a height below the upper edge and comprising at least one outlet spraying a second flow of wash liquid toward the peripheral side to provide a second wash zone along the peripheral side.

34. The dishwasher according to claim 33, wherein the peripheral side defines a plane, and at least one of the plurality of rotating spray heads sprays wash liquid through the plane at a positive acute angle with respect to the plane.

35. The dishwasher according to claim 34, wherein at least one of the plurality of rotating spray heads comprises another outlet that sprays wash liquid above the upper edge.

36. The dishwasher according to claim 33, wherein at least one of the plurality of rotating spray heads is oriented at an angle with respect to the vertical.

37. A dishwasher according to claim 33, and further comprising a second rack located in an upper portion of the wash chamber, and wherein the first rack is located in a lower portion of the wash chamber.

38. A dishwasher according to claim 33, wherein each spray head comprises a plurality of outlets distributed adjacent to and away from an axis of rotation of each spray head.

39. A dishwasher according to claim 38, wherein the outlets are arranged on each spray head such that wash liquid exiting the outlets causes each spray head to rotate about the axis of rotation.

40. A dishwasher according to claim 33, wherein the manifold further comprises a plurality of wash liquid conduits for supplying the plurality of rotating spray heads.

41. A dishwasher according to claim 33, wherein the plurality of rotating spray heads are directly adjacent the peripheral side.

42. A dishwasher according to claim 33, wherein the second wash zone is more intensified than the first wash zone.

43. A dishwasher according to claim 33, wherein the second wash zone is more concentrated than the first wash zone.

* * * * *